United States Patent [19]

Hujàla et al.

[11] Patent Number: 4,517,054

[45] Date of Patent: May 14, 1985

[54] WEB-FORMING SECTION OF A PAPER MACHINE INTENDED FOR MODERNIZATION OF A FOURDRINIER WIRE

[75] Inventors: Jorma Hujàla; Martti Koponen, both of Jyväskylä, Finland

[73] Assignee: Valmet OY, Finland

[21] Appl. No.: 430,232

[22] Filed: Sep. 29, 1982

[30] Foreign Application Priority Data

Mar. 2, 1982 [FI] Finland ..... 82 0743

[51] Int. Cl.[3] ..... D21F 7/02; D21F 9/02

[52] U.S. Cl. ..... 162/301; 162/306; 162/308; 162/312

[58] Field of Search ..... 162/300, 301, 310, 302, 162/305, 306, 203, 208, 312, 303, 308

[56] References Cited

U.S. PATENT DOCUMENTS

| | | | |
|---|---|---|---|
| 3,150,037 | 9/1964 | Lee | 162/208 |
| 3,846,233 | 11/1974 | Kankaanpaa | 162/312 |
| 4,100,018 | 7/1978 | Wahren et al. | 162/203 |
| 4,113,556 | 9/1978 | Kankaanpaa | 162/306 |

*Primary Examiner*—Steve Alvo

*Attorney, Agent, or Firm*—Steinberg & Raskin

[57] ABSTRACT

An improvement in a web-forming section of a paper machine intended as a modernization of a fourdrinier-wire part by which an improved formation of the web and an adjustable dewatering thereof by which better retention and desired distribution of fillers and fines is achieved. The web-forming section constitutes an improvement in an arrangement which includes a fourdrinier wire loop having a wire run which constitutes a lower wire of the web-forming section and which forms a single-wire initial portion of a dewatering zone of the web-forming section, and an upper wire unit which together with a run of the lower wire forms a two-wire dewatering zone within which dewatering takes place through the upper wire, wherein a first open faced forming roll is situated within the upper wire loop so that the two-wire dewatering zone begins in the region of the first forming roll, a horizontal plane tangent to the lower part of the first forming roll being substantially coplanar with the plane of the lower wire, a forming shoe within the fourdrinier wire loop having a curved deck which guides the joint run of the upper and lower wires, a reversing roll situated within the upper wire loop after the forming shoe and which guides a joint run of the upper and lower wires over an upwardly curved sector thereof until the joint run substantially coincides with the plane of the lower fourdrinier wire. Initial dewatering occurs in the single-wire initial portion of the dewatering zone to an appropriate extent through the lower wire. In the two-wire dewatering zone, dewatering occurs first within the sector of the first open forming roll in two directions through both the upper and lower wires whereupon within the region of the forming shoe, the dewatering takes place primarily upwardly through the upper wire.

16 Claims, 1 Drawing Figure

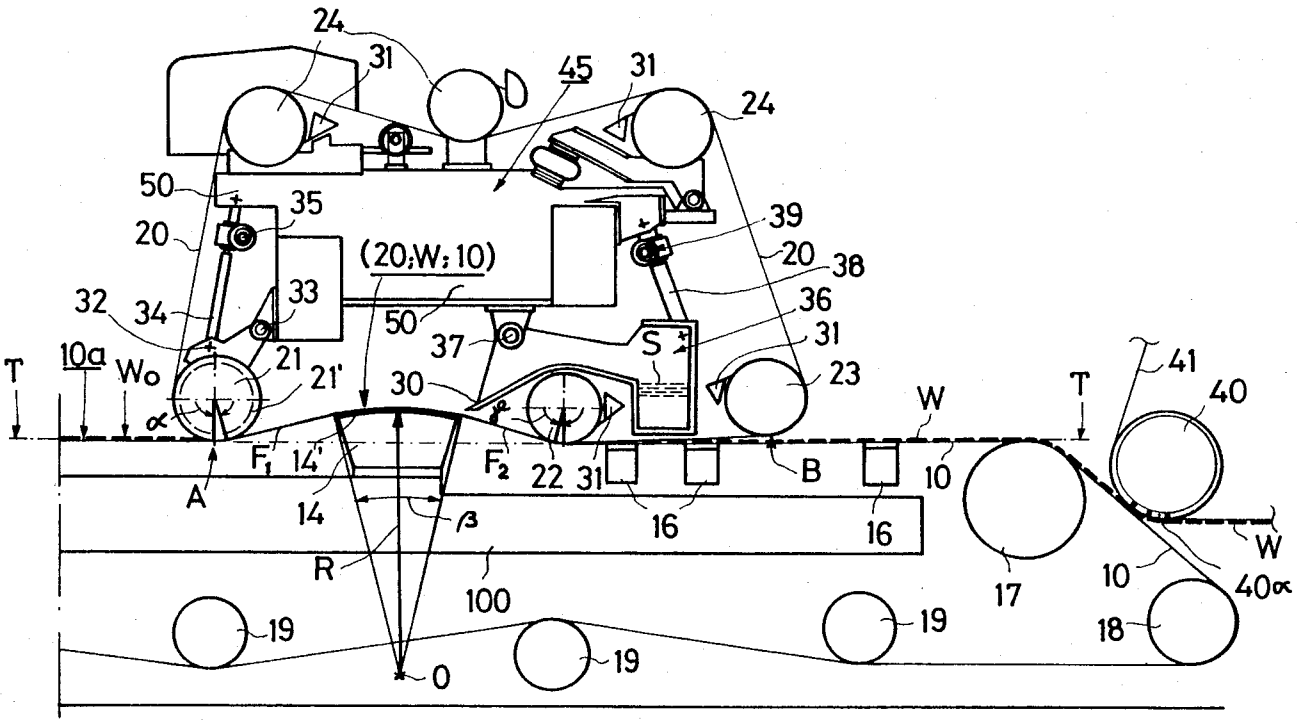
40
41
W
40α
10
18
T
17
W
10
16
19
B
23
24
39
20
38
36
31
S
16
31
22
45
F2
β
100
37
30
0
(20;W;10)
50
R
14
14'
21'
21
33
35
F1
A
24
31
50
20
34
32
Wo
α
10a
T

WEB-FORMING SECTION OF A PAPER MACHINE INTENDED FOR MODERNIZATION OF A FOURDRINIER WIRE

BACKGROUND OF THE INVENTION

The present invention relates generally to web-forming sections of a paper machine and, more particularly, to a web-forming section intended to modernize or constituting a modernization of a fourdrinier wire part.

Specifically, the present invention is directed to a web-forming section intended for the modernization of a fourdrinier wire part and which comprises a fourdrinier wire loop situated in respect to a headbox of the paper machine to form a single-wire, substantially horizontal initial portion of the dewatering zone in which the stock from which the web is to be formed is dewatered through a lower wire by means of draining means, the web-forming section also comprising an upper-wire unit including an upper wire guided by guide and web-forming rolls, the upper wire together with the run of the lower wire forming a two-wire dewatering zone within which dewatering takes place substantially upwardly through the upper wire.

Fillers, normally constituted by mineral substances, are often incorporated within paper in order to improve the printing and technical properties of the paper. The fillers are usually added into the pulp stock in the form of a water sludge. However, fillers do not adhere well to the fiber network of the stock which is a main reason for the poor retention of fillers therein. For this reason the filtering effect of the fiber network withholding the filler particles becomes an important factor affecting the retention of the fillers. The degree of filtering effect provided by the fiber network is determined by the thickness of the pulp web running on the wire, by the density of the fiber network, by the density of the wire and, moreover, by the draining or dewatering effects applied to the web.

Like the fines in paper, such as flours and coloring agents, fillers tend to be unevenly distributed in the direction of the thickness of the paper thereby causing a so-called unequal-sidedness in the paper. The unequal-sidedness of paper manufactured in fourdrinier machines results from the fillers being washed away along with the water which is drained from the lower portion of the pulp web in the filtrate water whereby the top portion of the web is enriched in fillers relative to the bottom portion of the web.

As is well known, attempts have been made to reduce the problems of unequal-sidedness of paper, not only by means of additives improving the retention of the fillers in the fiber network, but also by means of providing for a gentle dewatering during the initial filtering stage.

In prior art twin-wire formers, or so-called full-gap formers, which are now in common use, the pulp is supplied onto the wire part as a thin sludge whereupon a violent dewatering of the pulp web is begun immediately or after a short single-wire section, in both directions or in the same direction as in a single-wire section. This results in a considerable quantity of the fillers which have been added to the pulp, e.g. bolus, as well as fine fibers being carried away from the web along with the water being drained therefrom. Of course, this results in a considerable deterioration in the quality of the paper and, in particular, impairs the very properties intended to be provided to the paper by means of the fillers. Moreover, a simultaneous and violent two-sided dewatering also results in a weakening of the mid-portion of the paper web which in turn results in a low internal bond strength.

A two-wire former is disclosed in Finnish Pat. No. 50,648, assigned to applicants' assignee, in which the drawbacks discussed above are attempted to be avoided. This two-wire former is characterized by a single-wire initial portion of the wire part which is sufficiently long so that while a gentle dewatering takes place in the initial portion, the pulp web has time to obtain such a degree of felting prior to a two-wire portion of the wire part that the fibers can no longer be significantly shifted with respect to each other. Moreover, the two-wire portion of the wire part is guided, such as by a draining roll or by a draining box, so as to be curved downwardly whereby water is drained in the curved portion through the upper wire in a direction opposite to the direction of dewatering in the single-wire initial portion by the effects of centrifugal force and of a pressure zone produced by the tensioning between the wires. The main objective is to reduce the removal of additives to the pulp web, such as fillers, as well as to reduce the removal of fines from the pulp web and to increase the internal bond strength of the paper being manufactured.

It is well-known that in a conventional fourdrinier machine, dewatering of the web takes place only in the downward direction so that fines and filler agents are removed from the side of the web which faces the wire due to the washing effect of the foils or table rolls. For this reason a web manufactured in such a fourdrinier machine is anisotropic in regard to the properties of its two sides, the upper side of the web being smoother and containing more fines and fillers than the wire side. Moreover, the wire side of the web is left with a mark from the wires.

For the above reasons, paper made by means of two-wire formers is considered superior, especially with respect to printing properties. In such prior art two-wire formers in which no stationary dewatering elements are utilized, formation is usually poor and no pulsations of the dewatering pressure can be produced which would improve the formation. Another drawback of such prior art formers is that the same are not capable of adjusting the ratio of the quantities of water being dewatered through the upper and the lower wires. The desirability of providing the capability for such an adjustment has been expressed on several occasions.

Two-wire formers are also known in the art wherein the dewatering is mainly effected by stationary dewatering elements. However, in such prior art two-wire formers a drawback is present in that filler and fine retention is relatively poor whereas wire wear and power consumption is high.

Recently, modernizations of fourdrinier machines have become common in which one or more upper-wire units are situated above the fourdrinier wire unit by means of which an upward dewatering of the web is achieved with the objective of both increasing the dewatering capacity as well as improving web formation and filler and fine retention. An increased dewatering capacity in turn permits an increase in the speed of the paper machine. A further aim of such modernized fourdrinier machines is to provide the capability of reducing the thickness of the pulp supplied from the headbox which itself is advantageous. In certain cases, old low-speed news print machines have been converted or modernized by means of the upper-wire units of the type described above into board machines without increasing the speed of the machine. It is for these modernizations that the present invention provides an advantageous improvement.

As examples of prior art arrangements for modernizing fourdrinier wire parts, reference is made to Finnish patent application No. 782,709 (Beloit Walmsley Ltd.) and to British Pat. No. 1,582,342 (Australian Manufacturers Ltd. and Beloit Walmsley Ltd.). Reference is also made to U.S. Pat. No. 4,154,645 and to Finnish patent applications Nos. 810,373 and 811,514, all assigned to applicants' assignee.

SUMMARY OF THE INVENTION

Accordingly, it is a particular objective of the present invention to provide a new and improved two-wire web-forming section by means of which an improved formation of the web is achieved.

Another object of the present invention is to provide a new and improved web-forming section capable of providing for an adjustment in the ratio of the quantities of water being expelled through the upper and lower wires thereof making it possible to adjust the distribution of fillers and fines in the web.

Still another object of the present invention is to provide a new and improved web-forming section which provides more efficient dewatering primarily due to a longer active dewatering zone.

A further object of the present invention is to provide a new and improved web-forming section which will provide better retention for the fillers and fines within the pulp stock. Such retention has been particularly poor in prior art gap formers, especially in those in which stationary dewatering elements are mainly used. Good retention contributes, among other things, to reductions in energy costs and the elimination of the need for increasing the capacity of the headbox which would be otherwise necessary in the case of poor retention.

A still further object of the present invention is to provide a new and improved two-wire web-forming section wherein an improved support and stability of the wire runs within the two-wire dewatering zone is obtained. In this manner web formation is improved and streaks caused by the wire corrugations which would result from an unstable running of the wires are reduced.

Yet another object of the present invention is to provide a new and improved web-forming section which is particularly suited for paper types in which dewatering is relatively easy. Consequently, the former of the present invention is particularly suited for rather light webs in connection with which a gentle dewatering is utilized. In particular, the invention is particularly well suited for filler-containing, thin paper types.

Still yet another object of the present invention is to provide a new and improved web-forming sections wherein occurrence of pin-holes in the paper is reduced.

Briefly, in accordance with the present invention, these and other objects are attained by providing a web-forming section constituted by a combination of the following components arranged so as to be jointly operative as described below:

(a) a first forming roll having an open face and fitted within the loop of the upper wire, the two-wire forming zone beginning in the region of the said first forming roll and the forming zone being curved upwardly over a certain sector of the forming roll, and the horizontal plane which is tangential to the bottom of the forming roll substantially coinciding with the upper plane of the lower wire of the web-forming section, (b) a forming shoe situated after the said open forming roll within the two-wire dewatering zone and fitted within the loop of the lower wire, the forming shoe being provided with a curved deck placed in contact with the loop of the lower wire, which deck is curved downwardly over a certain angle and the face of which is located above the horizontal plane of the lower fourdrinier wire, (c) a reversing roll situated after the said forming shoe within the loop of the upper wire and guiding the joint runs of the upper and lower wires, the running of the wire being curved downwardly within a certain sector of the reversing roll and, thereby, substantially coinciding with the upper plane of the fourdrinier wire, (d) with the said open forming and reversing rolls and the forming shoe situated between them being arranged with respect to each other such that after the initial dewatering has taken place to an appropriate extent through the lower wire within the single-wire initial dewatering portion, the dewatering at first takes place within the two-wire dewatering zone within the sector of the first open roll in two directions through both wires whereupon the dewatering subsequently takes place within the range of the following forming shoe primarily upwardly through the upper wire.

With respect to the theory of draining through a two-wire curved forming zone, reference is made to the following publications:

*Papper och Tra* 1972, No. 4, pp. 137 to 146, Jouni Koskimies, Jorma Perkinen, Heikki Puolakka, Eero Schultz, Bjorn Wahlstrom: "A Drainage Model for the Forming Zone of a Two-Wire Former" and *Pulp and Paper Magazine of Canada,* vol. 74, No. 2/February 1973, pp. 72 to 77, E. G. Hauptmann and J. Mardon: "The Hydrodynamics of Curved Wire Formers".

Many important advantages are provided by the present invention with respect to prior art two-wire formers in which only rotary draining elements are used, such prior art formers constituting the starting point of the invention. An improved formation is obtained through the use of the forming shoe. An ability to adjust the drainage or dewatering of the web both with respect to the quantity as well as with respect to the ratio of dewatering through the top and bottom wires is achieved in that it is possible to provide suction arrangements within the curved drainage shoe, if necessary. By means of appropriately selecting the radius of curvature of the shoe and/or through a continuous or stepwise variation in the radius and/or by adjusting the position of the shoe, it is possible to control the dewatering capacity and even the direction of dewatering provided by the shoe. In this manner, it is possible to adjust the dewatering quantity within the single-wire initial dewatering portion of the forming section within wider limits than has been possible with prior art arrangements so that the dewatering which occurs in the initial single-wire dewatering zone is such that a quantity of water of an appropriate magnitude will remain within the web which will be dewatered through the upper wire in the two-wire dewatering zone by the roll-shoe combination in accordance with the invention.

DESCRIPTION OF THE DRAWINGS

A more complete appreciation of the present invention and many of the attendant advantages thereof will be readily understood by reference to the following detailed description when considered in connection with the accompanying drawing in which the sole FIGURE is a schematic side elevation view of a two-wire former in accordance with the present invention as applied to the modernization of a conventional fourdrinier wire part.

DESCRIPTION OF THE PREFERRED EMBODIMENTS

In accordance with the embodiment of the invention illustrated in the FIGURE, a paper machine forming section having a fourdrinier wire 10 has been modernized in accordance with the invention to convert it to a two-wire forming section. The plane of the wire of the original fourdrinier wire part is designated T-T. The forming section comprises a frame 100 of the existing wire part, dry suction boxes 16, a wire drive roll 17, a wire reversing roll 18, and guide rolls 19 which guide the lower run of the wire 10. All of these elements constitute components of the original wire part.

In the modernization of the fourdrinier wire part, a forming shoe 14 having a curved deck 14' is mounted on the existing frame 100. The radius of curvature of the deck 14' is designated R and the center of curvature is designated O.

An upper wire unit 45 comprises a frame portion 50 on which various components are mounted. The run of an upper wire loop 20 is guided from an initial region A of a two-wire section by an open forming roll 21 having a hollow face 21', followed by the forming shoe 14 and then by a first reversing roll 22 situated within the upper wire loop 20. The running of the two-wire section returns to the original plane T-T of the lower wire 10 in the region of the first reversing roll 22. The two-wire dewatering zone ends at a point prior to a second reversing roll 23 of the upper wire 20. The upper guide rolls of the upper wire 20 are denoted by reference numeral 24. The rolls 22, 23 and 24 are provided with doctor blades 31. The roll 21 is also provided with cleaning devices (not shown) and water collecting devices which are in themselves known per se.

Prior to the two-wire section, which begins at the initial region A and which ends at a point before the region designated B, a single-wire initial portion **10*a* of the dewatering zone exists. The single-wire initial dewatering portion 10*a* is constituted by the original wire 10 running in the plane T-T and dewatering takes place in the initial portion 10*a* by means of dewatering or drainage means situated between the slice of the headbox (not shown) and the region A and may constitute components which belonged to the existing fourdrinier wire part, such as forming boards and/or foils, which need not necessarily be replaced. Within the single-wire initial dewatering portion 10*a*, dewatering takes place in a downward direction through the lower wire 10**. However, such dewatering is preferably a relatively gentle dewatering so that the possibilities of good formation and retention are maintained and so that a sufficient amount of water will remain in the web for subsequent dewatering or drainage in an upward direction.

After the initial region A, the joint run of the wires 10 and 20 is curved upwardly within the sector $\alpha$ of the forming roll 21. The magnitude of the sector $\alpha$ is, for example, in the range of between about 5° to 45° and, preferably, is about 20°. Within the sector $\alpha$, the dewatering pressure is produced by the effect of the tensioning between the wires 10 and 20 and by the centrifugal forces which promote removal of water through the wire 10 and from the open face 21' of the roll 21.

After the sector $\alpha$, there is a joint straight run $F_1$ of the wires 10 and 20 whereupon the run of the wires 10 and 20 is curved downwardly at the shoe 14 over a sector $\beta$. Within the area of the shoe 14, dewatering of the web takes place under the effect of the compression between the wires 10 and 20 and by the effect of centrifugal forces acting upwardly through the upper wire 20. After the trailing edge of the shoe 14, there is a downwardly inclined straight joint run $F_2$ of the wires 10 and 20, whereupon the joint run of the wires 10 and 20 is curved upwardly over a sector $\gamma$ of the first return roll 22, whereupon the twin-wire run becomes situated in the original plane T-T of the lower wire 10.

The web W remains on the lower wire 10 and is detached therefrom on a downwardly slanting run between the rolls 17 and 18 by the effect of a suction zone 40$\alpha$ of a pick-up roll 40 whereby the web is transferred onto a pick-up fabric 41 which moves the web further into the press section (not shown).

The dewatering of the web which occurs in the two-wire dewatering zone will now be described in greater detail. When the web, designated $W_o$, arrives at the initial region A of the two-wire section after undergoing a gentle dewatering over the initial single-wire dewatering zone taking place through the wire 10, the web has obtained a suitable degree of felting, i.e., a degree of felting such that the fibers are unable in subsequent dewatering stages to move with respect to each other. As the web travels over the sector $\alpha$ of the face 21' of the open roll 21, in accordance with the present invention, an upwardly directed dewatering is begun through the upper wire 20 due to the open face 21' of the roll 21 under the effect of compression between the wires 10 and 20. This upward dewatering begins within the sector $\alpha$ in a very gentle manner and continues at the curved deck 14' of the forming shoe 14 under the effect of the centrifugal force caused by the curvature of the deck 14' of shoe 14 and under the effect of the tension between the wires 10 and 20. As the wires and web situated between them travel over the sector $\gamma$ of the return roll 22, some downward dewatering may still take place to the lower wire 10, there being at least some separation of water from the mesh of the lower wire 10.

Although some dry suction boxes 16 can be used to the extent necessary, the main principle of the present invention allows for a minimum number of such dry suction boxes 16 to be used and, in fact, it is even possible to totally eliminate the use of such dry suction boxes 16 thereby resulting in large savings in energy requirements.

The following features of the illustrated preferred embodiment should also be noted. The upper wire unit 45 is preferably designed such that the same can be shifted away from its illustrated position as an integral entity such, for example, as for maintenance. When the invention is applied in the modernization of a conventional fourdrinier wire part of a paper machine, no essential changes need be made to the frame 100 since the forming shoe 14 can be mounted in a simple and easy manner on the existing frame 100. The upper wire unit 45 comprises a frame 50 to which, for example, supporting means 32 for the first forming roll 21 are mounted, the supporting means 32 being connected to the frame 50 by means of horizontal articulated shafts 33. The open roll 21 is pressed against the lower wire 10 by means of rods 34 which can be shifted by means of worm gears 35.

Water collecting means are provided within the upper wire loop 20 mounted on the frame 50 by which water drained from the web within the area of the forming shoe 14 through the upper wire can be collected. In the illustrated embodiment, the water collecting means comprise a water collecting trough 36 the front edge 30 of the bottom of which is located within the region of a horizontal plane tangent to the uppermost region of the deck 14' of shoe 14. The water collecting trough 36 is suspended by means of articulated shaft 37 mounted on the frame 50. The trough 36 is arranged so as to be pivotable around the articulated shafts 37 by means of rods 38 which are operated by a worm gear 39. By means of rods 38 and gear 39, it is possible to adjust the position of the front edge 30 of the trough bottom at an appropriate position with a view toward collecting water drained from the web. The trough 36 includes appropriate devices and channels by which the water is removed through the side of the paper machine. The water level in the trough 36 is designated by reference S.

According to the invention, a sequence of drainage or dewatering steps are provided wherein the relative magnitudes, directions and pressures can be varied in a favorable manner with a view towards optimizing retention, formation and drainage capacity. Moreover, these objects are accomplished by relatively simple structures whose construction and operation have separately been established and tested in the past.

Advantageous constructional embodiments of the various drainage or dewatering elements of the web-forming section of the invention will now be described. As mentioned above, the first forming roll 21 must have a relatively open face so that dewatering can take place upwardly through the upper wire 20. The roll 21 may be either a vented roll or a blind-drilled roll. Preferably, the roll 21 is a spiral-groove coated roll constructed of a wound profile band in which the open proportion of the face, i.e., the percentage of the face occupied by grooves or holes over the entire mantle area, is preferably at least about 50%. The open hollow-face roll 21 is preferably covered by a wire sock. An appropriate diameter of the roll 21 is usually within the range of about 600 to 1500 mm.

With respect to the construction of the forming shoe 14, the radius of curvature R of shoe 14 may be constant or, alternatively, the radius of curvature R may become smaller in the running direction of the web W. In a preferred embodiment, the shoe 14 has a deck 14' having a radius of curvature R of about 3 m. In a second preferred embodiment, the deck 14' of shoe 14 has a radius of curvature of about 3 m. at the leading or forward edge and a radius of curvature of about 0.4 m. at the trailing edge. The deck 14' of shoe 14 which guides the wire 10 may be solid or provided with ribs and an at least partly open hollow-faced deck 14' is preferable, e.g., one that is provided with grooves which extend transversely with respect to the direction of running of the web W. When an open deck 14' of shoe 14 is utilized, the grooves or holes formed therein may be connected to a vacuum system and by means of appropriately adjusting the negative pressure within the deck 14' of the shoe it is possible to affect the quantity of water drained upwardly at least to some extent and it is indeed possible to produce at least some dewatering through the lower wire 10. The length of the shoe 14 is preferably such that the contact angle $\beta$ of the lower wire 10 with the deck 14' is about 5° to 45° depending upon the radius of curvature R of the deck. The run of the two-wire section 10, 12 changes its direction downwardly at a corresponding angle within the region of the shoe 14.

According to the illustrated preferred embodiment, the forming shoe 14 has a relatively long curved deck 14' which is located substantially mid-way between the rolls 21 and 22. Moreover, the shoe 14 is situated such that the upper tangential plane of the deck 14' is substantially coplanar with the plane which passes through the center axes of the rolls 21 and 22. Thus, the run $F_1$ of the wires 10, 20 between the roll 21 and the leading edge of the deck 14' is inclined upwardly at an angle $\alpha$ and, similarly, the corresponding twin-wire run $F_2$ between the trailing edge of the deck 14' and the roll 22 is inclined downwardly at an angle $\gamma$. The angle $\alpha$ is preferably substantially equal to the angle $\gamma$. It will be understood that according to the geometry of the preferred embodiment, $\beta=\alpha+\gamma$.

Moreover, in the illustrated preferred embodiment, the lowermost points of the rolls 21, 22 and 23 are substantially at the same level and, preferably, at the level T-T of the original fourdrinier wire 10. The rolls 21, 22 and 23 are situated with respect to each other such that sufficiently long spaces are provided whereby a forming shoe 14 having an appropriate radius of curvature R can be placed between the rolls 21 and 22 and such that a water collecting trough 36 can be situated between the rolls 22 and 23. Moreover, the distance between the rolls 22 and 23 is preferably sufficiently long so as to accommodate one or two dry suction boxes 16.

It should be again emphasized that the dewatering which occurs in the single-wire initial dewatering portion **10*a* constitutes a gentle dewatering so that to obtain a good retention of fillers and/or fines. Moreover, the amount of dewatering which takes place over the single-wire zone 10*a* must not be excessively large so that a sufficiently large amount of water remains for upwards dewatering through the upper wire 20. An adjustment of the quantities and proportions of dewatering taking place in various directions can be accomplished by appropriate selection of the radius and nature of the face of the roll 21, by appropriately selecting the radius of curvature and open nature of the deck 14' of the shoe 14, and through the adjustment of the positions and relative locations of the rolls 21 and 22 and shoe 14. If necessary, a fine adjustment of the final dewatering amounts and of the distribution of fines in the web can be accomplished by means of the dry suction boxes 16**.

It should also be noted that the web-forming section of the present invention can also be used as a multi-layer web former. For example, several web-forming units 45 of the type illustrated in FIG. 1 can be placed above the fourdrinier wire 10, one after the other, and a separate, secondary headbox arranged for each additional upper wire unit 45. For example, a separate secondary headbox can be situated at the upper run of the upper wire 20 to supply a pulp layer onto the main web supplied from the main headbox onto the lower wire 10.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a web-forming section of a paper machine, such as modernization of a fourdrinier-wire part, comprising a fourdrinier wire loop having a wire run constituting a lower wire of said web-forming section and a single-wire, substantially horizontal initial portion of a dewatering zone of the web-forming section within which web-forming stock is dewatered through the lower wire by draining means, said web-forming section further comprising an upper wire unit including a looped upper wire guided by guide and web-forming rolls, said upper wire together with a run of said lower wire forming a two-wire dewatering zone within which dewatering takes place substantially through the upper wire, the improvement comprising a combination of the following components arranged so as to be jointly operative as follows:

a first forming roll having an open face situated inside the upper wire loop, said two-wire dewatering zone beginning in the region of said first forming roll where said two-wire dewatering zone is curved upwardly over a sector of said first forming roll, and wherein a horizontal plane tangent to the lower part of said first forming roll is substantially coplanar with the plane of said lower wire and the open face of said first forming roll has an open area which is at least 50% of the entire area of said roll;

a forming shoe within the two-wire dewatering zone situated within the fourdrinier wire loop after said first open forming roll in the direction of web travel, said forming shoe being provided with a curved deck which contacts the lower wire, said deck being curved downwardly over a certain angle and wherein said deck has an upper face which is located above the plane of said lower wire;

a reversing roll situated inside the upper wire loop after said forming shoe in the direction of web travel and guiding a joint run of the upper and lower wires over an upwardly curved sector of said reversing roll until said joint run substantially coincides with the plane of said lower fourdrinier wire;

a second reversing roll situated within the upper wire loop for separating the upper wire from the lower wire before the upper wire reaches said second reversing roll; and wherein said forming and reversing rolls and forming shoe situated therebetween are situated with respect to each other such that after the initial dewatering occurs in the single-wire initial portion of the dewatering zone to an appropriate extent through the lower wire, dewatering takes place within the two-wire dewatering zone, first within said sector of said first open forming roll in two directions through both said upper and lower wires, whereupon within the region of said forming shoe, the dewatering takes place primarily upwardly through the upper wire, and wherein lowermost points of said first forming roll, said first reversing roll, and said second reversing roll are all disposed at substantially the same level.

2. The combination of claim 1 wherein the upper and lower wires are guided so that after the two-wire dewatering zone, the web follows the lower wire, and further including pick-up means for detaching the web from the lower wire.

3. The combination of claim 1 further including water collecting means situated within the upper wire loop of the upper wire unit for collecting water dewatered from the upper wire and passing the collected water to a side of said forming section.

4. The combination of claim 1 wherein said curved deck of said forming shoe is located between said forming and said reversing rolls such that a plane tangential to the upper region of said curved deck is substantially coplanar with a plane which passes through the axes of rotation of said forming and first reversing rolls.

5. The combination of claim 1 further including at least one dry suction box arranged within the lower wire loop after said first reversing roll over said curved sector of which the joint run of the upper and lower wires substantial coincide with the plane of said lower fourdrinier wire.

6. The combination of claim 1 wherein said first open forming roll is selected from the group consisting of a vented roll, a blind-drilled roll, a through-drilled roll and a suction roll.

7. The combination of claim 6 wherein said first open forming roll is covered by a wire sock.

8. The combination of claim 1 wherein said curved deck of said forming shoe has a constant radius of curvature.

9. The combination of claim 1 wherein said curved deck of said forming shoe has a radius of curvature which decreases in size from the leading edge of said deck towards the trailing edge of said deck.

10. The combination of claim 1 wherein said forming shoe has a solid smooth curved deck.

11. The combination of claim 1 wherein said forming shoe has a hollow-faced deck formed with cavities therein.

12. The combination of claim 13 wherein said cavities in said deck are connected to a suction system for precisely controlling dewatering.

13. The combination of claim 1 wherein said reversing roll which guides the joint run of the upper and lower wires over an upwardly curved sector thereof is a smooth-faced solid roll.

14. The combination of claim 1 wherein said reversing roll which guides the joint run of the upper and lower wires over an upwardly curved sector thereof is a hollow-faced roll.

15. The combination of claim 1 wherein at least one upper wire unit is provided above the lower wire and further including secondary headboxes fitted in connection with the upper wire unit from which headboxes a pulp layer is supplied onto a main web supplied from a main headbox onto the lower wire.

16. The combination of claim 1 wherein the lowermost points of said respective rolls are all disposed at substantially the level of said single wire at said substantially horizontal single-wire portion of said dewatering zone.

* * * * *